US007477856B2

(12) United States Patent
Yoneda et al.

(10) Patent No.: US 7,477,856 B2
(45) Date of Patent: Jan. 13, 2009

(54) METHOD AND APPARATUS FOR IMAGE FORMING CAPABLE OF EFFECTIVELY PREVENTING RESONANCE OF FREQUENCIES

(75) Inventors: Takuzi Yoneda, Tokyo (JP); Hiroshi Ono, Tokyo (JP); Masanori Kawasumi, Kanagawa (JP); Yuji Arai, Kanagawa (JP); Toshio Koike, Kanagawa (JP); Ken Amemiya, Tokyo (JP); Tokuya Ohjimi, Kanagawa (JP); Takatsugu Fujishiro, Tokyo (JP); Masami Tomita, Shizuoka (JP); Haruji Mizuishi, Tokyo (JP); Hitoshi Ishibashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 335 days.

(21) Appl. No.: 11/271,814

(22) Filed: Nov. 14, 2005

(65) Prior Publication Data

US 2006/0133834 A1 Jun. 22, 2006

(30) Foreign Application Priority Data

Nov. 12, 2004 (JP) ..... 2004-329245

(51) Int. Cl.
*G03G 15/00* (2006.01)

(52) U.S. Cl. ..... 399/48; 399/50

(58) Field of Classification Search ..... 399/48, 399/50

See application file for complete search history.

(56) References Cited

U.S. PATENT DOCUMENTS 4,885,466 A 12/1989 Koichi et al.

(Continued)

FOREIGN PATENT DOCUMENTS

JP 02093658 A * 4/1990

(Continued)

OTHER PUBLICATIONS

U.S. Appl. No. 11/855,353, filed Sep. 14, 2007, Shintani et al.

(Continued)

*Primary Examiner*—David M Gray
*Assistant Examiner*—Erika J. Villaluna
(74) *Attorney, Agent, or Firm*—Oblon, Spivak, McClelland, Maier & Neustadt, P.C.

(57) ABSTRACT

An image forming apparatus including an image bearing member, a charging member, and a measuring member. The image forming member is configured to bear an image. The charging member is configured to charge a surface of the image bearing member when a direct current bias voltage is added to at least an alternating bias voltage which is applied to the charging member, and has a frequency fc of the alternating bias voltage. The measuring member is configured to measure a potential of the surface of the image bearing member, and has a drive frequency fvsen. The relationship of the frequency fc and the drive frequency fvsen is expressed as fc≠fvsen×n and fc×n≠fvsen.

17 Claims, 3 Drawing Sheets

U.S. PATENT DOCUMENTS

| | | | | |
|---|---|---|---|---|
| 6,754,462 | B2 | 6/2004 | Fujishiro | |
| 6,756,175 | B2 | 6/2004 | Emoto et al. | |
| 6,757,508 | B2 | 6/2004 | Fujishiro | |
| 7,162,173 | B2 * | 1/2007 | Motohashi et al. | 399/50 |
| 2007/0098424 | A1 * | 5/2007 | Okada | 399/50 |

FOREIGN PATENT DOCUMENTS

| | | | |
|---|---|---|---|
| JP | 05119515 | A * | 5/1993 |
| JP | 2000305311 | A * | 11/2000 |
| JP | 2002-169357 | | 6/2002 |

OTHER PUBLICATIONS

U.S. Appl. No. 11/512,385, filed Aug. 30, 2006, Tomita.
U.S. Appl. No. 11/935,106, filed Nov. 5, 2007, Muraishi et al.
U.S. Appl. No. 11/943,713, filed Nov. 21, 2007, Ishikawa et al.

* cited by examiner

METHOD AND APPARATUS FOR IMAGE FORMING CAPABLE OF EFFECTIVELY PREVENTING RESONANCE OF FREQUENCIES

CROSS REFERENCE TO RELATED APPLICATIONS

The present application claims priority to Japanese patent application no. 2004-329245, filed in the Japan Patent Office on Nov. 12, 2004, the disclosure of which is incorporated by reference herein in its entirety.

BACKGROUND OF THE INVENTION

1. Field of the Invention

The present invention relates to a method and apparatus for image forming, and more particularly to: an image forming apparatus applying an electrophotographic process for effectively preventing resonance of a frequency of an alternating bias voltage and a drive frequency of a potential measuring member by adding a direct-current bias voltage to the alternating bias voltage as a charging bias voltage; a method processed by the image forming apparatus; and a process cartridge used by the image forming apparatus.

2. Discussion of the Related Art

Typically, an image forming apparatus applying an electrophotographic process includes a photoconductive element as an image bearing member, and operates to charge the surface of the photoconductive element, to form an electrostatic latent image on the surface of the photoconductive element, to develop the electrostatic latent image by supplying toner to the surface of the photoconductive element, to transfer the developed toner image onto a recording medium, to fix the developed image on the recording medium, and to then output the recording medium. After transferring the developed image onto the recording medium, the surface of the photoconductive element is cleaned with a cleaning unit so that residual toner does not exert a negative influence on the next image forming process. It is generally known to use a cleaning blade including elastic bodies, such as rubber, to remove incrustations such as remaining toner as the cleaning unit.

SUMMARY OF THE INVENTION

The present invention has been made in view of the above-described circumstances.

An object of the present invention is to provide a novel image forming apparatus that prevents charging nonuniformity and filming by avoiding resonance of a charging frequency of an alternating bias voltage and a drive frequency of a tuning fork of a surface potential sensor.

Another object of the present invention is to provide a novel method of image forming using the above-described image forming apparatus.

Another object of the present invention is to provide a novel process cartridge mounted on the above-described novel image forming apparatus.

In one embodiment, a novel image forming apparatus includes an image bearing member, a charging member, and a measuring member. The image bearing member is configured to bear an image. The charging member is configured to charge a surface of the image bearing member by adding a direct current bias voltage to at least an alternating bias voltage. The charging member has a frequency fc of the alternating bias voltage. The measuring member is configured to measure a potential of the surface of the image bearing member. The measuring member has a drive frequency fvsen. The relationship of the frequency fc and the drive frequency fvsen may be expressed as $fc \neq fvsen \times n$ and $fc \times n \neq fvsen$.

The charging member may include a charging roller.

The novel image forming apparatus may be configured to use toner having a volume-based average particle diameter from approximately 3 μm to approximately 8 μm and a distribution from approximately 1.00 to approximately 1.40. The distribution may be defined by a ratio of the volume-based average particle diameter to a number-based average diameter.

The novel image forming apparatus may be configured to use the toner having a shape factor "SF-1" in a range from approximately 100 to approximately 180, and a shape factor "SF2" in a range from approximately 100 to approximately 180.

The novel image forming apparatus may be configured to use the toner obtained from at least one of an elongation and a crosslinking reaction of toner composition comprising a polyester prepolymer having a function group including a nitrogen atom, a polyester, a colorant, and a releasing agent in an aqueous medium under resin fine particles.

The image forming apparatus may be configured to use the toner having a spindle outer shape, and a ratio of a major axis r1 to a minor axis r2 from approximately 0.5 to approximately 1.0 and a ratio of a thickness r3 to the minor axis r2 from approximately 0.7 to approximately 1.0, and $r1 \geqq r2 \geqq r3$.

Further, in one embodiment, a novel method of image forming includes charging a surface of an image bearing member by overlapping a direct current bias voltage with at least an alternating bias voltage with a frequency fc, and measuring a potential of the surface of the image bearing member with a frequency fvsen, in which a relationship of the frequency fc and the drive frequency fvsen is expressed as $fc \neq fvsen \times n$ and $fc \times n \neq fvsen$.

Further, in one embodiment, a novel process cartridge includes an image bearing member configured to bear an image, a charging member configured to charge a surface of the image bearing member by overlapping a direct current bias voltage with at least an alternating bias voltage and have a frequency fc of the alternating bias voltage, and a measuring member configured to measure a potential of the surface of the image bearing member and having a drive frequency fvsen. The relationship of the frequency fc and the drive frequency fvsen may be expressed as $fc \neq fvsen \times n$ and $fc \times n \neq fvsen$.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
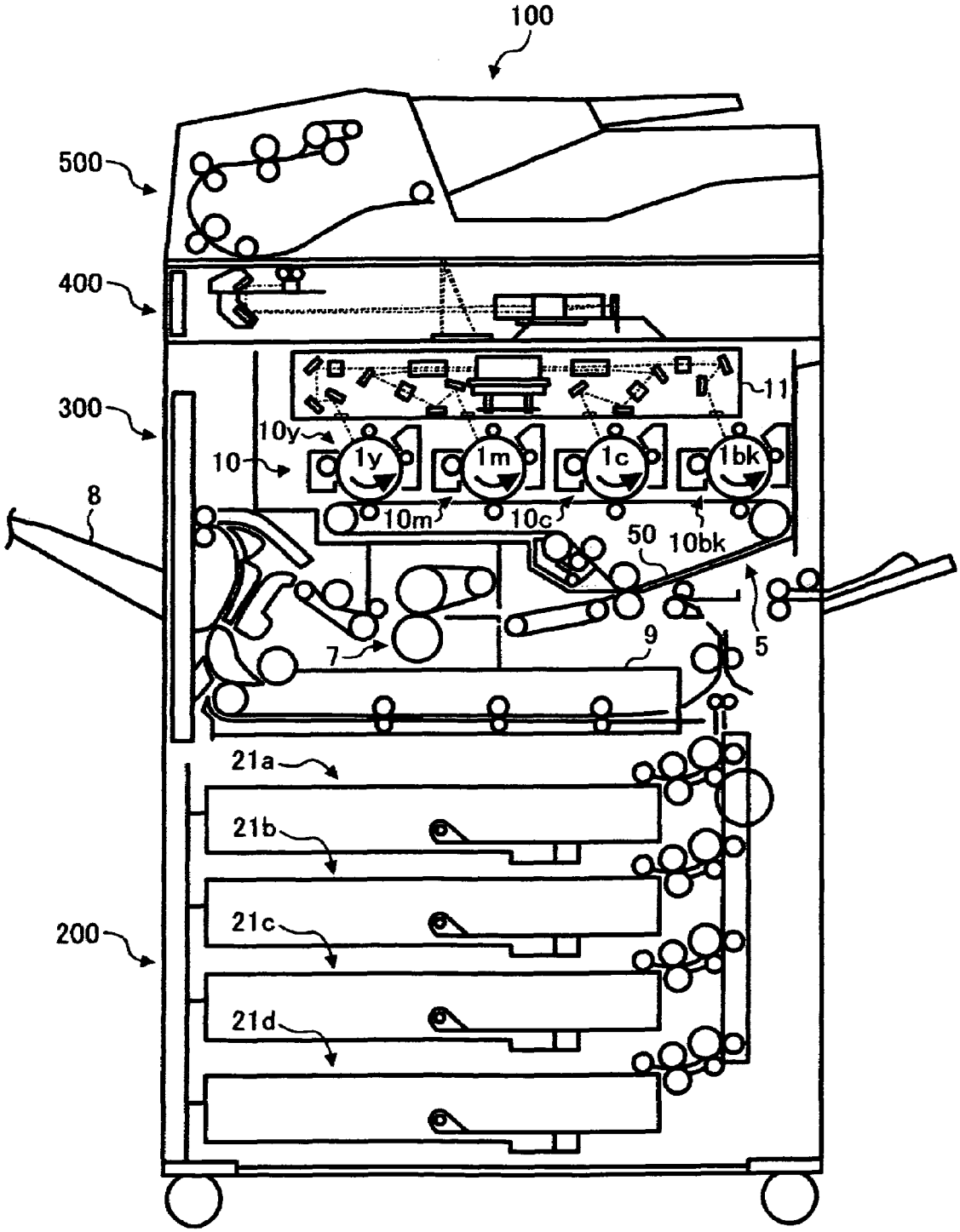
FIG. 1 is a schematic drawing of an image forming apparatus according to an exemplary embodiment of the present invention.

Recently, a charging unit including a charging roller formed by a conductive element has been used to charge the surface of the photoconductive element. The charging roller is disposed in contact with or in the vicinity of the surface of the photoconductive element to apply voltage between the charging roller and the photoconductive element so that the charging unit can reduce production of ozone and consumption of power.

To uniformly charge the surface of the photoconductive element, a system that applies a charging bias added to a direct-current bias voltage with an alternating-current bias voltage is generally used. In general, an image forming apparatus employing this type of system supplies a greater amount of alternating current to obtain a desirable charging potential compared with a system using a direct current. Further, image quality depends on an amount of toner adhering to the surface of the photoconductive element. Therefore, it is preferable to provide a sensor, such as a surface potential sensor, in a development phase so that the charged surface of the photoconductive element may be kept in a predetermined optimal condition.

The image forming apparatus may include a tandem-type color image forming apparatus with a plurality of photoconductive elements. Such color image forming apparatus, however, may be provided with a charging member disposed opposite to a photoconductive element corresponding to the charging member, which can produce a charging sound caused by a frequency (charging frequency) of the alternating-current voltage. It is assumed that the charging sound may be a vibration sound of the charging member and/or a tapping sound on the surface of the photoconductive element caused when the charging member applied with the alternating-current voltage is slightly vibrated by its frequency or a sound caused when a slight gap formed between the photoconductive element and the charging member varies to allow air to flow through the gap. Further, the above-described sound occurs substantially at the same time in every image forming unit of the image forming apparatus, which results in a production of noise. The level of the noise increases especially when the frequency of the alternating-current voltage to be applied is approximately 900 Hz.

In one technique, an image forming apparatus using electrophotography includes a plurality of photoconductive drums and a plurality of charging members corresponding to the plurality of respective photoconductive drums, and uses a charging control method in which a first phase of an alternating-current voltage applied to at least one of the plurality of charging members is shifted to a second phase of an alternating-current voltage applied to the plurality of charging members different from the first phase, so that every phase of the respective alternating-current voltages applied to the respective charging members may be shifted.

When an image forming apparatus uses a surface potential sensor to keep the charging condition on the surface of a photoconductive drum thereof to a predetermined optimal value, the charging frequency of an alternating-current voltage still resonates with the drive frequency of a surface potential sensor to cause noise in an alternating charging current, which results in charging nonuniformity and filming.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1 of the drawings, an exemplary structure of an image forming apparatus according to an exemplary embodiment of the present invention is described and directed mainly toward the first object. In the following, a full-color copier is used to exemplify this embodiment.

In FIG. 1, an image forming apparatus 100 includes a sheet feeding mechanism 200, an image-forming mechanism 300, an image scanning mechanism 400, and a document feeding mechanism 500. The image forming mechanism 300 includes a transfer unit 5, a fixing unit 7, an image forming unit group 10, and an optical writing unit 11.

The image forming unit group 10 includes four image forming units 10*y*, 10*m*, 10*c*, and 10*bk* that are separately arranged at positions having horizontal heights or elevations forming tandem-type image forming mechanism to form yellow (y) images, magenta (m) images, cyan (c) images, and black (bk) images, respectively, as shown in FIG. 1. The image forming units 10*y*, 10*m*, 10*c*, and 10*bk*, respectively, have drum-shaped photoconductive elements 1*y*, 1*m*, 1*c*, and 1*bk*, serving as image bearing members, and corresponding to the four colors y, m, c, and bk, respectively. The four image forming units 10*y*, 10*m*, 10*c*, and 10*bk* can have similar structures and functions, except that the toners are different colors to form yellow images, magenta images, cyan images and black images, respectively. In the vicinity of each of the photoconductive elements 1*y*, 1*m*, 1*c*, and 1*bk*, a charging unit 2, a lubricant applying unit 3, a developing unit 4, a cleaning unit 6, and a surface potential sensor 8 are provided, which will be described later with reference to FIG. 2.

The optical writing unit 11 converts image data read by the document feeding mechanism 400 or image signals supplied from an external device (not shown) such as a Personal Computer (PC), and uses a polygon motor to conduct laser beam scanning. Then, the optical writing unit 11 forms respective electrostatic latent images on the photoconductive elements 1*y*, 1*m*, 1*c*, and 1*bk*, based on scanning image signals via a mirror.

The transfer unit 5 includes an intermediate transfer belt 50 disposed below the image forming unit group 10. The intermediate transfer belt 50 is an endless belt and carries respective color toner images sequentially overlaid thereon from the respective photoconductive elements 1*y*, 1*m*, 1*c*, and 1*bk*.

At the same time, a recording medium is selectively fed from one of sheet feeding cassettes 21*a*, 21*b*, 21*c*, and 21*d* of the sheet feeding mechanism 200.

When the recording medium is conveyed in synchronization with a movement of the image forming mechanism 300, the overlaid color toner image on the intermediate transfer belt 50 is transferred onto the recording medium.

Alternatively, a recording medium may be carried by a transfer carrier belt, and the respective color toner images on the photoconductive elements 1*y*, 1*m*, 1*c*, and 1*bk* may be directly transferred onto the recording medium.

The fixing unit 7 includes a pressure applying roller and a belt tensed by rollers incorporating a heat source such as a halogen heater. During passage through a nip part formed between the pressure applying roller and the belt, heat and pressure are applied to the color toner image on the recording medium to fix the toner image. Alternatively, a pair of rollers or a pair of belts may be used in the fixing unit 7.

The image forming apparatus 100 may optionally include a duplex print unit 9 and a sheet discharging tray 8.

Figure 2:
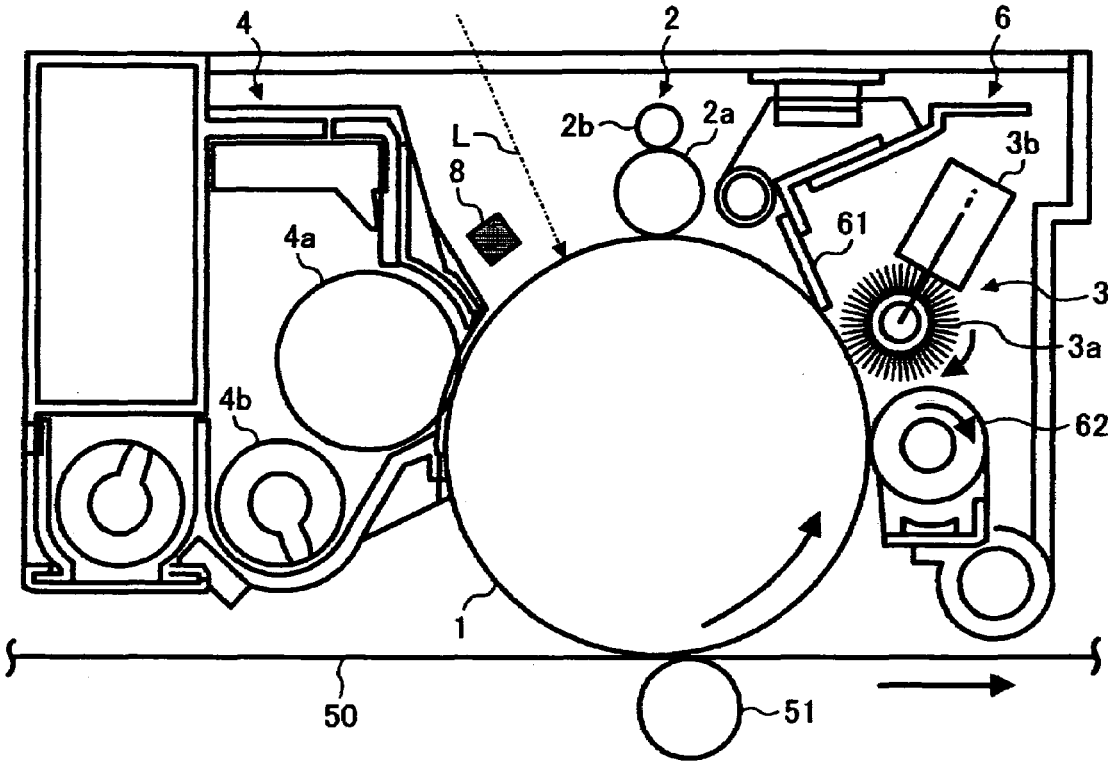
FIG. 2 is an enlarged view showing an image forming unit of the image forming apparatus shown in FIG. 1.

Referring to FIG. 2, an enlarged view showing a schematic of one unit of the image forming unit group 10 shown in FIG. 1 is described. As previously described, the image forming units 10*y*, 10*m*, 10*c*, and 10*bk* have respective components having similar structures and functions to each other, except that the toners contained therein are of different colors. Therefore, the discussion below with respect to FIG. 2 uses reference numerals for specifying components of the image forming apparatus 100 without suffixes indicative of colors such as y, m, c, and bk. In FIG. 2, the image forming unit that is one of the image forming units 10*y*, 10*m*, 10*c*, and 10*bk* may be a process cartridge detachable with respect to the image forming apparatus 100. The process cartridge may include the photoconductive element 1, and at least one of the charging unit 2, the developing unit 4, and the cleaning unit 6.

In FIG. 2, the photoconductive element 1 may be formed of a photoconductive amorphous metal such as amorphous silicon and amorphous selenium. Alternatively, the photoconductive element 1 may be formed of organic compounds such as bisazo pigment and phthalocyanine pigment. If an environmental influence and postprocessing after use thereof are taken into account, an OPC photoconductive element using an organic compound is preferred.

The charging unit 2 may be any of a corona type, a roller type, a brush type, and a blade type. In FIG. 2, the charging unit 2 is configured to form a roller type charging unit.

The charging unit 2 includes a charging roller 2*a* and a charging roller cleaning member 2*b*. The charging roller 2*a* is a charging member disposed facing the photoconductive element 1. The charging roller cleaning member 2*b* is disposed facing the charging roller 2*a*, opposite to the photoconductive element 1. The charging roller 2*a* may be held in contact with or form a gap with respect to the photoconductive element 1. The charging unit 2 further includes a power source (not shown) connected to the charging roller 2*a* and the charging roller cleaning member 2*b* for the purpose of cleaning the charging roller 2*a*. When a predetermined voltage is applied to the charging roller 2*a*, the surface of the photoconductive element 1 is discharged uniformly between the charging unit 2 and the photoconductive element 1. The voltage may be a direct-current bias voltage added to an alternating bias voltage. By applying the alternating bias voltage to the charging roller 2*a*, the surface of the photoconductive element 1 may uniformly be charged. Nonuniform charging to the surface of the photoconductive element 1 may adversely effect an image, for example, deteriorating image quality. To avoid such effect, the surface potential sensor 8 serving as a non-contact measuring member of a surface potential is employed to measure a charging condition of the surface of the photoconductive element 1. The surface potential sensor 8 will be described below.

The developing unit 4 includes a developer bearing member 4*a* to supply a developer supported thereon to the photoconductive element 1 and a toner supply area 4*b*. The developer bearing member 4*a* is hollow-cylinder shaped and is rotatably supported. The developer bearing member 4*a* accommodates a magnet roller fixed to have the same rotational axis as the rotatable developer bearing member 4*a*. The developer is magnetically absorbed and carried on the outer circumferential surface of the developer bearing member 4*a*. The developer bearing member 4*a*, which is made of a conductive and non-magnetic member, is connected to a power source (not shown) for applying development bias. An electric field is formed in a development area by providing a voltage from the power source between the developer bearing member 4*a* and the photoconductive element 1.

A primary transfer member 51 is disposed at a position opposite to the photoconductive element 1 and the intermediate transfer belt 50 is sandwiched there between.

The primary transfer member 51 is connected to a power source (not shown). When a toner image on the photoconductive element 1 is to be transferred onto the intermediate transfer belt 50, a voltage is applied to the primary transfer member 51. Then, an electric field is formed between the photoconductive element 1 and the intermediate transfer belt 50, and hence, the toner image is electrostatically transferred.

The cleaning unit 6 includes the lubricant applying unit 3, a cleaning blade 61, and a cleaning brush 62. The cleaning blade 61 may be formed in a plate shape with a rubber material such as urethane rubber and silicone rubber.

The lubricant applying unit 3 is disposed at a position downstream of a position where the photoconductive element 1 and the primary transfer member 51 sandwich the intermediate transfer belt 50 in a rotation direction of the photoconductive element 1, downstream of the cleaning brush 62, and upstream of the cleaning blade 61. After being applied onto the surface of the photoconductive element 1 by the lubricant applying unit 3, the lubricant is rubbed and spread so that a thin layer of the lubricant may be formed on the surface of the photoconductive element 1.

The lubricant applying unit 3 includes a lubricant brush 3a and a solid lubricant material 3*b*. The lubricant brush 3*a* is disposed in contact with the solid lubricant material 3*b*. The lubricant brush 3*a* scrapes lubricant of the solid lubricant material 3*b* away to supply the lubricant onto the surface of the photoconductive element 1. The lubricant brush 3*a* is held in contact with the solid lubricant material 3*b* by its own weight in this exemplary embodiment. Alternatively, the lubricant brush 3*a* may be provided with a pressure spring. By pressing the lubricant brush 3*a* with the pressure spring, the lubricant brush 3*a* may scrape the solid lubricant material 3*b* to apply it onto the surface of the photoconductive element 1.

Typical examples of the solid lubricant material 3*b* are given below. However, the solid lubricant material 3*b* to be used is not restricted only to these examples. The solid lubricant material 3*b* may be made of an aliphatic metal salt such as lead oleate, zinc oleate, cupper oleate, zinc stearate, cobalt stearate, iron stearate, cupper stearate, zinc palmitate, cupper palmitate, or zinc linolenate. Preferably, the solid lubricant material 64 is made of zinc stearate.

As previously described, the surface potential sensor 8 is employed to measure a charging condition of the surface of the photoconductive element 1. In FIG. 2, the surface potential sensor 8 is disposed downstream of the charging unit 2 and upstream of the developing unit 4 in the rotation direction of the photoconductive element 1.

The following describes the surface potential sensor 8.

A tuning fork has a U-shaped metal stick and is generally used to attune instrumentals. When the tuning fork performs an opening and closing movement, it makes a sound close to a pure tone of a constant frequency. Based on the principle of the tuning fork, a small tuning-fork-type pendulum including a piezoelectric ceramic is made to sense the opening and closing movement due to vibration, resulting in a surface potential sensor that is widely used in an electrophotographic image forming apparatus. That is, assume that a sensing electrode of the surface potential sensor 8 is disposed opposite to the photoconductive element 1 that is charged with a negative pulse. A positive charge may be induced on the sensing electrode, and an electrostatic bond may be caused due to an electric line of force.

Under the above-described condition, the tuning-fork-type pendulum is disposed between the photoconductive element 1 and the sensing electrode to cause the tuning-fork-type pendulum to vibrate so that the opening and closing movement may occur. The opening and closing movement may increase and decrease an amount of electric line of force to reach the sensing electrode. The change of the amount of electric line of force can be obtained as a signal to reflect the amount of surface potential.

When measuring the surface potential of the photoconductive element 1 with certain conditions, resonance occurs between a frequency of an alternating bias applied to the charging roller 2*a* to charge the surface of the photoconductive element 1 and a drive frequency of the tuning fork of the surface potential sensor 8. This creates a noise in the alternating bias, which can have a remarkable effect on the quality of an image. Experiments were conducted to find a cause of the occurrence of the resonance.

In general, a protective measure such as using shielding may be taken to prevent the drive frequency of the surface potential sensor 8 from having an effect on the alternating bias. It is difficult, however, to take a substantial enough measurement because the units around the photoconductive element 1 have a complex shape.

In response to this problem, a relationship to remarkably reduce the noise of the alternating bias was discovered. To reduce the noise of the alternating bias, the discovered relationship can be expressed as $fc \neq fvsen \times n$ and $fc \times n \neq fvsen$, where "fc" represents a frequency of the alternating bias voltage, "fvsen" represents a drive frequency of the surface potential sensor 8, and "n" represents an integer.

Experiments using a real image forming appartus, when the drive frequency of the surface potential sensor 8 (the EFS series, manufactured by TDK CORPORATION) was set to 700 Hz, the frequency of the alternating bias voltage was set to 2,100 Hz, and an applying voltage was set to 2,400 Vpp. That is, when the relationship was expressed as $fc=fvsen \times 3$, the alternating bias voltage was measured to have a noise of approximately 100 Vpp.

The frequency of the alternating bias voltage is determined based on a linear velocity of the photoconductive element 1 according to a printing speed. The frequency of the alternating bias voltage may be set to a level equal to or more than seven times as large as the linear velocity of the photoconductive element 1 to prevent a charging nonuniformity to the surface of the photoconductive element 1, and equal to or less than nine times the linear velocity of the photoconductive element 1 to present filming. The image forming apparatus used for the experiment of the present invention has a printing speed of 80 A4-size recording sheets per minute. According to the above-described settings, the linear velocity of the photoconductive element 1 is calculated as 1.5 times the length of the A4-size recording sheet up to 280 mm/sec; and the frequency of the alternating bias voltage is calculated as seven to nine times the linear velocity of the photoconductive element 1—between 1,960 Hz and 2,502 Hz.

Further, when the tolerance of the frequency is 5%, the frequency of the alternating bias voltage, to prevent the charging nonuniformity and filming, may be in a range from 2,059 to 2,393 Hz. The above-described range, however, does not allow for frequencies of 2,100 Hz and 2,400 Hz which are products of integral multiplicands multiplied by the drive frequency of the surface potential sensor 8. Further, when the 1% tolerances of the respective frequencies are considered, the frequencies in ranges between 2,079 and 2,121 Hz and between 2,376 and 2,393 Hz cannot be set as the frequency of the alternating bias voltage. Therefore, the settable frequency of the alternating bias voltage is determined to be in a range between 2,059 and 2,078 Hz and a range between 2,122 and 2,375 Hz. When using the real image forming apparatus, setting the frequency of the alternating bias voltage to 2,250 Hz, since the value is substantially a mean value between the values of 2,122 Hz and 2,375 Hz, and setting the drive frequency of the surface potential sensor 8 to 700 Hz, substantially no noise was identified on the alternating bias voltage. Also, an image was produced with high quality.

Further, the above-described surface potential sensor 8 may be integrally assembled with the photoconductive element 1 and at least one of the charging unit 2, the developing unit 4, and the cleaning unit 6 in the process cartridge (not shown).

The process cartridge may be detachably attached to the image forming apparatus 100 for easy maintenance. When a problem related to the photoconductive element 1, the charging unit 2, the developing unit 4, the cleaning unit 6, the surface potential sensor 8, or the like occurs, the replacement of the process cartridge may quickly restore the image forming apparatus 100 to its original state, thereby reducing the service period for maintenance. Increasing the cleaning ability of the photoconductive element 1 may contribute to a longer life of the process cartridge.

The image forming apparatus 1 may effectively work especially when using a small and substantially spherical toner as described below. Since there is a demand for a high image quality, it is preferable that the surface potential sensor 8 precisely obtain a charged surface potential on the surface of the photoconductive element 1.

Now, the volume average particle diameter and the number average particle diameter of toner, which will be understood by those skilled in the art, are notated as Dv and Dn, respectively. When using toner having a small particle diameter and a concentrated particle diameter distribution, such as toner having a Dv value of between 3 and 8 μm and a ratio (Dv/Dn) between 1.00 and 1.40, the developing unit 4 performs well.

Generally, it is said that the smaller the toner particle diameter, the more advantageous to produce high resolution and quality images. However, the small particle diameter of the toner may result in reduced transferability and cleaning ability. When the volume-average particle diameter is smaller than 3 μm, the resultant toner in a two-component developer melts and adheres to a surface of a carrier due to a long agitation process in the developing unit 4, resulting in a deterioration of the chargeability of a carrier. When the toner is used in a one-component developer, toner filming may be caused over a developer bearing member 4*a* and adhere to a member such as a blade forming a thin layer thereof. When the volume-average particle diameter is greater than 8 μm, the resultant toner is difficult to use to produce high resolution and quality images.

Such concentrated particle distribution causes a uniform electrification distribution, resulting in high-quality fog-free images and achieving an improved transfer rate.

When Dv/Dn is greater than 1.40, the charged amount distribution of the resultant toner widens and the toner produces images having deteriorated image resolution.

The average particle diameter and particle diameter distribution of the toner can be measured by a Coulter counter method. Coulter counter TA-II and Coulter Multisizer II from BECKMAN COULTER, INC. are used to measure the particle diameter distribution of a toner particle. In the present invention, an Interface producing a number distribution and a volume distribution from NIKKAKI BIOS CO., LTD. and a personal computer PC9801 from NEC CORP. are connected with the Coulter Multisizer II to measure the average particle diameter and particle diameter distribution.

Toner may include a wax that is internally or externally added to a toner particle to increase the releasing ability of the toner particle from, for example, the surface of the photoconductive element, and an inorganic fine particle that is used to increase the flowing ability of toner. Since the above-described toner can be smaller than prior art toner, the rate of waxes and inorganic fine particles may be greater. Consequently, the wax and inorganic fine particles may increase the amount of toner which adheres to the surface of the photoconductive element 1.

To reduce the amount of adherence of toner onto the surface of the photoconductive element 1, the lubricating unit 3 may uniformly form a thin layer of lubricant on an entire surface of the photoconductive element 1. Further, a frictional force exerted between the surface of the photoconductive element 1 and the cleaning blade 61 of the cleaning unit 6 may be reduced so that the cleaning ability can be improved.

It is preferable that a shape factor "SF-1" of the toner used in the developing unit 4 is in a range from approximately 100 to approximately 180, and the shape factor "SF-2" of the toner is in a range from approximately 100 to approximately 180.

Figure 3A:
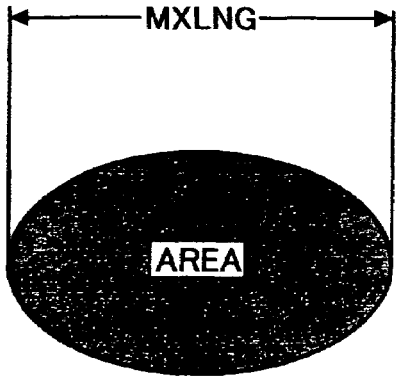
FIGS. 3A and 3B are schematic views showing exemplary toner shapes for the purpose of explaining shape coefficients SF-1 and SF-2.

Referring to FIG. 3A, the shape factor "SF1" is a parameter representing the roundness of a particle. The shape factor "SF-1" of a particle is calculated by the following Equation 1:

$$SF1=\{(MXLNG)^2/AREA\}\times(100\pi/4) \quad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 3B:
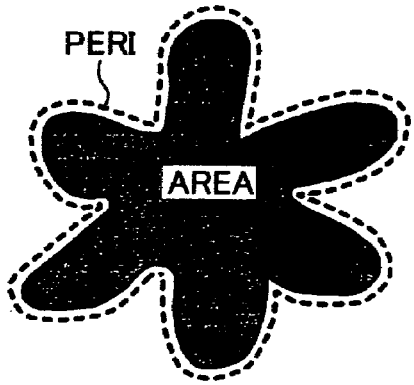

Referring to FIG. 3B, the shape factor "SF-2" is a value representing irregularity (i.e., a ratio of convex and concave portions) of the shape of the toner. The shape factor "SF-2" of a particle is calculated by the following Equation 2:

$$SF2=\{(PERI)^2/AREA\}\times(100\pi/4) \quad \text{Equation 2,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

As a toner particle has a higher roundness, the toner particle is more likely to make a point-contact with another toner particle on the photoconductive element 1. In this case, the adhesion force between these toner particles is weak, thereby making the toner particles highly flowable. Also, while weak adhesion force between the round toner particle and the photoconductive element 1 enhances the transfer rate, the round toner is more likely to cause cleaning malfunction for a blade type cleaning mechanism. However, in this case, the cleaning device 6 of the present invention can clean up the toner particles well. It is noted that large SF-1 and SF-2 values may deteriorate visual quality of an image due to scattered toner particles on the image. It is preferable that the SF-1 and SF-2 values be less than 180.

In this embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

The preferred toner for use in an image forming apparatus according to the present invention is produced through bridge reaction and/or elongation reaction of a liquid toner material in aqueous solvent. Here, the liquid toner material is generated by dispersing polyester prepolymer including an aromatic group having at least nitrogen atom, polyester, a coloring agent, and a release agent in organic solvent. In the following, toner constituents and a toner manufacturing method are described in detail.

(Modified Polyester)

Toner according to an embodiment of the present invention includes modified polyester (i) as a binder resin. As the modified polyester (i), the polyester resin may include a bond group other than an ester bond. Also, in the polyester resin, different resin constituents may be covalent and/or ion bonded to each other. Specifically, the modified polyester may result from modification of polyester residues by introducing a functional group such as an isocyanate group reacted with a hydroxyl group and a carboxylic acid group to polyester residues and further reacting the resulting compound with an active hydrogen including compound.

The modified polyester (i) may be urea-modified polyester generated by reaction of polyester prepolymer (A) having an isocyanate group and an amine class (B). The polyester prepolymer (A) having an isocyanate group may be generated by reacting polyester, which is a polycondensation compound of polyalcohol (PO) and polycarboxylic acid (PC) and includes polyester having an active hydrogen group, to a polyisocyanate (PIC) compound. Such an active hydrogen group of the polyester may be a hydroxyl group (alcoholic-hydroxyl group and phenolic-hydroxyl group), an amino group, a carboxyl group, and a mercapto group. Among these groups, the alcoholic-hydroxyl group is preferred.

The urea-modified polyester is generated as follows.

A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1.4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of the above-mentioned bisphenols (ethylene oxide, propylene oxide, butylene oxide or the like).

Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) may be divalent carboxylic acid (DIC) and tri- or more valent polycarboxylic acid (TC). Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges from 1.5/1 through 1/1. In particular, the ratio is preferably between 1.3/1 and 1.02/1.

Specific examples of the polyisocyanate (PIC) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as ααα α -te-trarnethylxylylenediisocyanate; isocyanurate; the above-mentioned polyisocyanate blocked with phenol derivatives, oxime and caprolactam; and their combinations.

The polyisocyanate (PIC) is mixed with a polyester such that the equivalent ratio ([NCO]/[OH]) between the isocyanate group [NCO] of the polyisocyanate (PIC) and the hydroxyl group [OH] of the polyester is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When the molar ratio of [NCO] is less than 1, the urea content in the resultant modified polyester decreases and hot offset resistance of the resultant toner deteriorates.

The content of the constitutional unit obtained from a polyisocyanate (PIC) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of amino acid (B5) are aminopropionic acid and caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention include a urea-modified polyesters (i). The urea-modified polyester (i) may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

Modified polyesters such as the urea-modified polyester (i) can be produced by a method such as one-shot methods and prepolymer methods. The weight-average molecular weight of the urea-modified polyester (i) is not less than 10,000, preferably from 20,000 to 10,000,000 and more preferably from 30,000 to 1,000,000. In addition, the peak molecular weight is preferably from 1,000 to 10,000. When the peak molecular weight is less than 1,000, an elongation reaction tends not to occur and elasticity of the toner is low, hence hot offset resistance of the resultant toner deteriorates. When the peak molecular weight is more than approximately 10,000, fixability is impaired and manufacturing problems may occur, for example, in the particle formation process or the pulverization process. The number-average molecular weight of the urea-modified polyester (i) is not particularly limited when the unmodified polyester resin (ii) described below is used in combination. Namely, the weight-average molecular weight of the urea-modified polyester resins has priority over the number-average molecular weight thereof. However, when the urea-modified polyester (i) is used alone, the number-average molecular weight is not greater than 20,000, preferably from 1,000 to 10,000, and more preferably from 2,000 to 8,000. When the number-average molecular weight is greater than 20,000, the low temperature fixability of the resultant toner deteriorates, and in addition the glossiness of full color images deteriorates.

A reaction anticatalyst can optionally be used in the crosslinking and/or elongation reaction between the polyester prepolymer (A) and amines (B) to control a molecular weight of the resultant urea-modified polyesters, if desired. Specific examples of the reaction anticatalyst include monoamines such as diethyl amine, dibutyl amine, butyl amine and lauryl amine, and blocked amines, i.e., ketimine compounds prepared by blocking the monoamines described above.

The molecular weight of polymers including tetrahydrofuran (THF) as a soluble component can be measured by a method such as gel permeation chromatography (GPC).

(Unmodified Polyester)

In the present invention, not only the urea-modified polyester (i) alone, but also the unmodified polyester resin (ii) can be included as a toner binder with the urea-modified polyester (i). A combination thereof improves low temperature fixability of the resultant toner and glossiness of color images produced thereby. A combination of unmodified polyester and urea-modified polyester improves low temperature fixability of the resultant toner and glossiness of color images produced. Consequently, the combination is more preferable to use than the urea-modified polyester alone.

Suitable unmodified polyester resin (ii) include polycondensation products of a polyol (PO) and a polycarboxylic acid (PC) similar to the urea-modified polyester (i). Specific examples of the polyol (PO) and the polycarboxylic acid (PC) are the same as those for use in the urea-modified polyester (i). Polyester resins modified by a bonding such as urethane bonding other than a urea bonding can be considered to be the unmodified polyester in the present invention. It is preferable that the urea-modified polyester (i) at least partially mixes with the unmodified polyester resin (ii) to improve the low temperature fixability and hot offset resistance of the resultant toner. Therefore, the urea-modified polyester (i) preferably has a structure similar to that of the unmodified polyester resin (ii). A mixing ratio ((i)/(ii)) between the urea-modified polyester (i) and polyester resin (ii) is from 5/95 to 80/20 by weight, preferably from 5/95 to 30/70 by weight, more preferably from 5/95 to 25/75 by weight, and even more preferably from 7/93 to 20/80 by weight. When the weight ratio of the urea-modified polyester (i) is less than 5%, the hot offset resistance deteriorates, and in addition, it is difficult to impart a good combination of high temperature preservability and low temperature fixability of the toner.

The peak molecular weight of the unmodified polyester (ii) is generally 1,000 to 10,000, preferably 2,000 to 8,000, and more preferably 2,000 to 5,000. When the peak molecular weight thereof is less than approximately 1,000, heat-resistant storability is impaired. When the peak molecular weight thereof is more than approximately 10,000, low temperature fixability is impaired. It is preferable that the hydroxyl value of (ii) is not less than 5. A hydroxyl value in a range of 10 to 120 is preferable and a range of 20 to 80 is particularly preferable. If the hydroxyl value is less than approximately 5, it is difficult to impart a good combination of heat resistance storability and low temperature fixability. The acid value of the unmodified polyester (ii) is approximately 1 to approximately 5, and preferably 2 to 4. Since a wax having a high acid value is generally used as a wax component of the toner, it is preferable to use the resin having a low acid value as a toner binder because a good charge property and high volume resistivity can be imparted to the resultant toner. Thus, the toner formed from such a wax and a resin is suitable for a two-component toner.

The toner binder preferably has a glass transition temperature (Tg) of from 35° C. to 70° C., and preferably from 55° C. to 65° C. When the glass transition temperature is less than 35° C., the high temperature preservability of the toner deteriorates. When the glass transition temperature is higher than 70° C., the low temperature fixability deteriorates. Due to a combination of the modified polyester, such as urea-modified polyester, and polyester resin, the toner of the present invention has better high temperature preservability than conventional toners including a polyester resin used as a binder resin even though the glass transition temperature is low.

The gas transition temperature (Tg) can be calculated by differential scanning calorimetry (DSC).

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1 to 15% by weight, and more preferably from 3 to 10% by weight, based on the total weight of the toner.

The colorants mentioned above for use in the present invention can be used as master batch pigments by being combined with a resin.

The examples of binder resins to be kneaded with the master batch or used in the preparation of the master batch are styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used alone or in combination.

(Charge Controlling Agent)

Specific examples of the charge controlling agent include known charge controlling agents such as Nigrosine dyes, triphenylmethane dyes, metal complex dyes including chromium, chelate compounds of molybdic acid, Rhodaminedyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative) PR, COPY CHARGE NEG VP2036 and NX VP434 (quaternary ammonium salt), which are manufactured by Hoechst AG; LRA-901, and LR-1-47 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added, the toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity. Consequently, the electrostatic force of a developing roller attracting the toner increases, resulting in deterioration of the fluidity of the toner and decrease of the image density of toner images.

(Releasing Agent)

A wax for use in the toner of the present invention as a releasing agent has a low melting point of from 50° C. to 120° C. When such a wax is included in the toner, the wax is dispersed in the binder resin and serves as a releasing agent at a location between a fixing roller and the toner particles. Thereby, hot offset resistance can be improved without applying an oil to the fixing roller used. Specific examples of the releasing agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

These charge controlling agents and releasing agents can be dissolved and dispersed after being kneaded and receiving an application of heat together with a master batch pigment and a binder resin; and can be added when directly dissolved and dispersed in an organic solvent.

(External Additives)

The inorganic particulate material preferably has a primary particle diameter of from $5\times10^{-3}$ to 2 μm, and more preferably from $5\times10^{-3}$ to 0.5 μm. In addition, a specific surface area of the inorganic particulates measured by a BET method is preferably from 20 to 500 $m^2/g$. The content of the external additive is preferably from 0.01 to 5% by weight, and more preferably from 0.01 to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, it is preferable to use hydrophobic silica fine grains and hydrophobic titanium oxide fine grains in combination. Particularly, when such two kinds of fine grains, having a mean grain size of $5\times10^{-2}$ μm or below, are mixed together, there can be noticeably improved an electrostatic force and van del Waals force with the toner. Therefore, despite agitation effected in the developing device for implementing the desired charge level, the fluidity imparting agent does not part from the toner grains and insures desirable image quality free from spots or similar image defects. In addition, the amount of residual toner can be reduced.

Titanium oxide fine grains are desirable for environmental stability and image density stability, but tend to have lower charge start characteristics. Therefore, if the amount of titanium oxide fine particles is larger than the amount of silica fine grains, then the influence of the above side effect increases. However, so long as the amount of hydrophobic silica fine grains and hydrophobic titanium oxide fine grains is between 0.3 wt. % and 1.5 wt. %, the charge start characteristics are not noticeably impaired, i.e., desired charge start characteristics are achievable. Consequently, stable image quality is achievable despite repeated copying operations.

The toner of the present invention is produced by the following method, but the manufacturing method is not limited thereto.

[Preparation of Toner]

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium, 3-1omega-fluoroalkanoyl(C6-C8)-N-ethylamino}-1-propanesulfonate, fluoroalkyl(C11-C20)carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16)ethylphosphates, etc.

Specific examples of the marketed products of such surfactants having a fluoroalkyl group include SARFRON® S-111, S-112 and S-113, which are manufactured by ASAHI GLASS CO., LTD.; FLUORAD® FC-93, FC-95, FC-98 and FC-129, which are manufactured by SUMITOMO 3M LTD.; UNIDYNE® DS-101 and DS-102, which are manufactured by DAIKIN INDUSTRIES, LTD.; MEGAFACE® F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT® F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON® S-121 (manufactured by ASAHI GLASS CO., LTD.); FLUORAD® FC-135 (manufactured by SUMITOMO 3M LTD.); UNIDYNE DS-202 (manufactured by DAIKIN INDUSTRIES, LTD.); MEGAFACE® F-150 and F-824 (manufactured by DAINIPPON INK AND CHEMICALS, INC.); ECTOP EF-132 (manufactured by TOHCHEM PRODUCTS CO., LTD.); FUTARGENT® F-300 (manufactured by NEOS); etc.

Resin fine particles are added to stabilize toner source particles formed in the aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile)particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g.,β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 to 20 μm. The number of rotations of the high speed shearing type dispersers is not particularly limited, but is usually 1,000 rpm (revolutions per minute) to 30,000 rpm, and preferably 5,000 to 20,000 rpm. While the dispersion time is not limited, it is usually 0.1 to 5 minutes for the batch system. The dispersion temperature is usually 0° C. to 150° C., and preferably 40 to 98° C. under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product), and the resultant particles are washed and then dried. Thus, mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge controlling agent is penetrated into the mother toner particles, and inorganic fine particles such as silica, titanium oxide etc. are added externally thereto to obtain the toner of the present invention.

In accordance with a well-known method, for example, a method using a mixer, the charge controlling agent is provided, and the inorganic particles are added.

Thus, a toner having a small particle size and a sharp particle size distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition from a smooth surface to a rough surface such as the surface of pickled plum.

Toner according to an embodiment of the present invention has a substantially spherical shape as provided by the following shape definition.

Figure 4A:
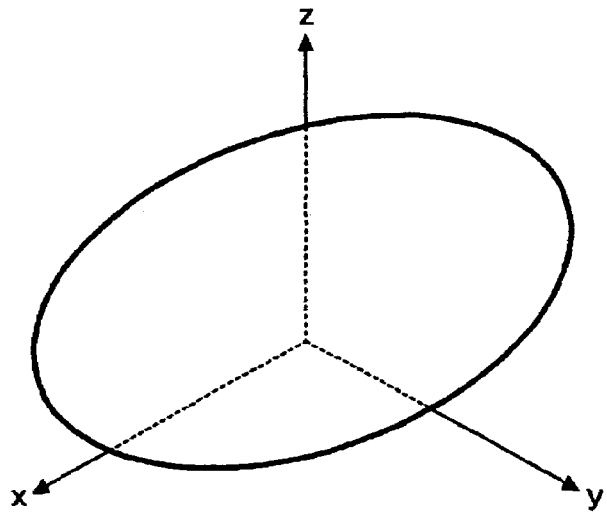
FIGS. 4A, 4B, and 4C show exemplary shapes of a toner particle according to an embodiment of the present invention.
Figure 4B:
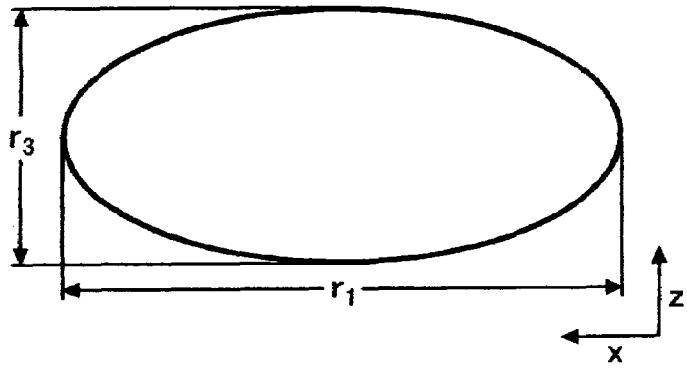
Figure 4C:
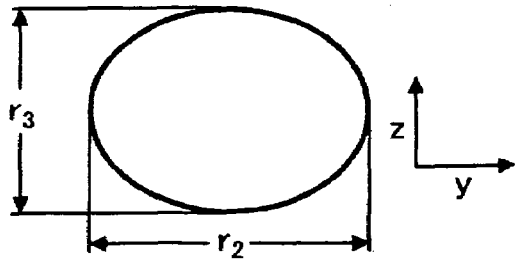

FIGS. 4A through 4C are schematic views showing an exemplary shape of a toner particle according to an embodiment of the present invention.

An axis x of FIG. 4A represents a major axis r1 of FIG. 4B, which is the longest axis of the toner. An axis y of FIG. 4A represents a minor axis r2 of FIG. 4C, which is the second longest axis of the toner. The axis z of FIG. 4A represents a thickness r3 of FIG. 4B, which is a thickness of the shortest axis of the toner. The toner has a relationship between the major and minor axes r1 and r2 and the thickness r3 as follows:

$$r1 \geqq r2 \geqq r3.$$

The toner of FIG. 4A is preferably in a spindle shape in which the ratio (r2/r1) of the major axis r1 to the minor axis r2 is approximately 0.5 to approximately 1.0, and the ratio (r3/r2) of the thickness r3 to the minor axis is approximately 0.7 to approximately 1.0.

It is noted that the lengths r1, r2 and r3 are measured by taking pictures of the toner particle from different viewing angles by using a scanning electron microscope (SEM).

Toner manufactured in this manner can be used as single-component magnetic toner without a magnetic carrier or non-magnetic toner.

Also, if the manufactured toner is used in two-component developer, the toner may be mixed with magnetic carrier. Such a magnetic carrier may be a ferrite containing divalent metal such as iron, magnetite, manganese, zinc and copper, and preferably has a volume average particle diameter of 20 through 100 μm. If the average particle diameter is less than 20 μm, it is likely that the carrier may be attached on the photoconductive element 1 during development. On the other hand, if the average diameter is larger than 100 μm, toner particles are insufficiently electrified because of an unsatisfactory mixture. In this case, when the developing device is continuously operated, there is a risk that electrification may malfunction. Also, zinc containing Cu ferrite is preferred because of high saturation magnetization. However, ferrite may be selected depending on a process of the image forming apparatus 100. Magnetic carrier covering resin is not limited to a certain resin. For example, the magnetic carrier covering resin may be silicone resin, styrene-acryl resin, fluorine-contained resin, olefin resin or the like. The magnetic carrier covering resin may be manufactured by dissolving coating resin, in solvent and spraying the resulting solution in a fluidized bed to coat the resin on a core. Alternatively, after resin particles are electrostatically attached to core particles, the resulting particles may be melted for the coverage. The thickness of the covered resin is normally between 0.05 and 10 μm, and preferably between 0.3 and 4 μm.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

an image bearing member configured to bear an image;

a charging member configured to charge a surface of the image bearing member when a direct current bias voltage added to at least an alternating bias voltage is applied to the charging member, the charging member having a frequency fc of the alternating bias voltage; and a measuring member configured to measure a potential of the surface of the image bearing member, the measuring member having a drive frequency fvsen, wherein a relationship of the frequency fc and the drive frequency fvsen is expressed as $fc \neq fvsen \times n$ and $fc \times n + fvsen$, where n is an integer.

2. The image forming apparatus according to claim 1, wherein the charging member includes a charging roller.

3. The image forming apparatus according to claim 1, wherein the image forming apparatus is configured to use toner having a volume-based average particle diameter from approximately 3 μm to approximately 8 μm and a distribution from approximately 1.00 to approximately 1.40, wherein the distribution is defined by a ratio of the volume-based average particle diameter to a number-based average diameter.

4. The image forming apparatus according to claim 1, wherein the image forming apparatus is configured to use toner having a shape factor "SF-1" in a range from approximately 100 to approximately 180, and a shape factor "SF2" in a range from approximately 100 to approximately 180.

5. The image forming apparatus according to claim 1, wherein the image forming apparatus is configured to use toner obtained from at least one of an elongation and a crosslinking reaction of toner composition comprising a polyester prepolymer having a function group including a nitrogen atom, a polyester, a colorant, and a releasing agent in an aqueous medium under resin fine particles.

6. The image forming apparatus according to claim 1, wherein the image forming apparatus is configured to use toner having a spindle outer shape, and a ratio of a major axis r1 to a minor axis r2 from approximately 0.5 to approximately 1.0 and a ratio of a thickness r3 to the minor axis r2 from approximately 0.7 to approximately 1.0, where r1≧r2≧r3.

7. An image forming apparatus, comprising:

an image bearing member configured to bear an image;

means for charging a surface of the image bearing member when a direct current bias voltage added to at least an alternating bias voltage is applied to the means for charging, the means for charging having a frequency fc of the alternating bias voltage; and means for measuring a potential of the surface of the image bearing member, the means for measuring having a drive frequency fvsen, wherein a relationship of the frequency fc and the drive frequency fvsen is expressed as fc≠fvsen×n and fc×n+fvsen, where n is an integer.

8. The image forming apparatus according to claim 7, wherein the means for charging includes a charging roller.

9. The image forming apparatus according to claim 7, wherein the image forming apparatus is configured to use toner having a volume-based average particle diameter from approximately 3 μm to approximately 8 μm and a distribution from approximately 1.00 to approximately 1.40, wherein the distribution is defined by a ratio of the volume-based average particle diameter to a number-based average diameter.

10. The image forming apparatus according to claim 7, wherein the image forming apparatus is configured to use toner having a shape factor "SF-1" in a range from approximately 100 to approximately 180, and a shape factor "SF2" in a range from approximately 100 to approximately 180.

11. The image forming apparatus according to claim 7, wherein the image forming apparatus is configured to use toner obtained from at least one of an elongation and a crosslinking reaction of toner composition comprising a polyester prepolymer having a function group including a nitrogen atom, a polyester, a colorant, and a releasing agent in an aqueous medium under resin fine particles.

12. The image forming apparatus according to claim 7, wherein the image forming apparatus is configured to use toner having a spindle outer shape, and a ratio of a major axis r1 to a minor axis r2 from approximately 0.5 to approximately 1.0 and a ratio of a thickness r3 to the minor axis r2 from approximately 0.7 to approximately 1.0, where r1≧r2≧r3.

13. A method of image forming, comprising the steps of:

charging a surface of an image bearing member with a charging member charged with a direct current bias voltage added to at least an alternating bias voltage having a frequency fc; and measuring a potential of the surface of the image bearing member using a sensor having a drive frequency fvsen, wherein a relationship of the frequency fc and the drive frequency fvsen is expressed as fc+fvsen×n and fc×n+fvsen, where n is an integer.

14. A process cartridge, comprising:

an image bearing member configured to bear an image;

at least one of(a) a charging member configured to charge a surface of the image bearing member when a direct current bias voltage added to at least an alternating bias voltage is applied to the charging member, the charging member having a frequency fc of the alternating bias voltage, (b) a developing member configured to develop the image, and (c) a cleaning member configured to remove toner remaining on the image bearing member; and a measuring member configured to measure a potential of the surface of the image bearing member, the measuring member having a drive frequency fvsen, wherein a relationship of the frequency fc and the drive frequency fvsen is expressed as fc+fvsen×n and fc×n+fvsen, where n is an integer.

15. The process cartridge according to claim 14, wherein the charging member includes a charging roller.

16. A process cartridge, comprising:

an image bearing member configured to bear an image;

at least one of (a) means for charging a surface of the image bearing member when a direct current bias voltage added to at least an alternating bias voltage is applied to the means for charging, the means for charging having a frequency fc of the alternating bias voltage, (b) means for developing the image, and (c) means for removing toner remaining on the image bearing member; and means for measuring a potential of the surface of the image bearing member, the means for measuring having a drive frequency fvsen, wherein a relationship of the frequency fc and the drive frequency fvsen is expressed as fc+fvsen×n and fc×n+fvsen, where n is an integer.

17. The process cartridge according to claim 16, wherein the means for charging includes a charging roller.

* * * * *